United States Patent [19]

Lebo

[11] 3,994,066

[45] Nov. 30, 1976

[54] KNIFE FOR CRAFTSMEN

[75] Inventor: Gary Lebo, Chicago, Ill.

[73] Assignee: Lawrence Peska Associates, Inc., New York, N.Y. ; a part interest

[22] Filed: Aug. 28, 1975

[21] Appl. No.: 608,696

[52] U.S. Cl. ..... 30/321; 30/296 A

[51] Int. Cl.[2] ..... B26B 1/04; B26B 3/08

[58] Field of Search ..... 30/320, 336, 171, 330, 30/89, 293, 321, 296 A, 317

[56] References Cited

UNITED STATES PATENTS

| | | | |
|---|---|---|---|
| 1,917,779 | 7/1933 | Stowell | 30/171 |
| 2,507,872 | 5/1950 | Unsinger | 30/336 X |
| 3,158,411 | 11/1964 | Moulin | 30/330 X |
| 3,922,784 | 12/1975 | Prince | 30/321 X |

FOREIGN PATENTS OR APPLICATIONS

| | | | |
|---|---|---|---|
| 374,259 | 6/1932 | United Kingdom | 30/320 |

*Primary Examiner*—Al Lawrence Smith
*Assistant Examiner*—J. C. Peters

[57] ABSTRACT

A blade receiver and a handle, having opposed abrasive surfaces, are connected by a screw and a nut whereby the screw and nut are operable to press the abrasive surfaces together. The blade receiver includes a chuck and collet where a blade of the knife is removeably retained.

7 Claims, 4 Drawing Figures

KNIFE FOR CRAFTSMEN

BACKGROUND OF THE INVENTION

1. Field of Invention

This invention relates to hand tools and more particularly to a cutting tool.

2. Description of the Prior Art

A craftsman often desires to cut a workpiece which is disposed within a restrictive space, such as close to a wall. The craftsman may be prevented by the shape of the knife from placing the cutting edge of a blade of the knife in a position to cut the workpiece.

Typically, the blade is moveable with respect to a handle of the knife to either a first angular position respect to the handle, with the cutting edge is substantially perpendicular to the handle, or to a second angular position, with the cutting edge substantially parallel to the handle.

Although the moveability of the blade may be of some help to the craftsman, it may be desirable to move the blade to an angular position intermediate to the first and second angular positions. Additionally, it may be desirable to rotate the blade about the axis of its shank when the blade is in either the first, the second or the intermediate angular position.

Because the cutting edge becomes dull when it is used, it is desirable for the craftsman to be able to remove the blade from the knife and replace it. Usually, when the knife is constructed to have the blade moveable to a plurality of angular positions, the blade is not easily removed and, therefore, cannot be easily replaced.

Heretofore, a knife having an easily replaceable blade, moveable to the desired intermediate angular position and rotatable about the axis of its shank has been unknown in the prior art.

SUMMARY OF THE INVENTION

An object of the present invention is to provide a knife which is used to cut a workpiece disposed within a restrictive space.

Another object of the present invention is to provide a knife having a blade which is easily removed from the knife and replaced.

According to one aspect of the present invention, a blade receiver and a handle are mounted for pivotal movement about a pivot which is operable to press together abutting abrasive surfaces of said blade receiver and said handle.

According to another aspect of the invention, said blade receiver includes a chuck and collet where a shank of a tool is removably retained.

The present invention provides a knife having a blade receiving portion moveable to a multiplicity of angular positions with respect to a handle of the knife. Additionally, a blade having a cylindrical shank is retained in the knife in any desired rotational position about the axis of the shank.

Other objects, features and advantages of the present invention will become more apparent in the light of the following detailed description of a preferred embodiment thereof as illustrated in the accompanying drawing.

DESCRIPTION OF THE PREFERRED EMBODIMENT

Figure 1:
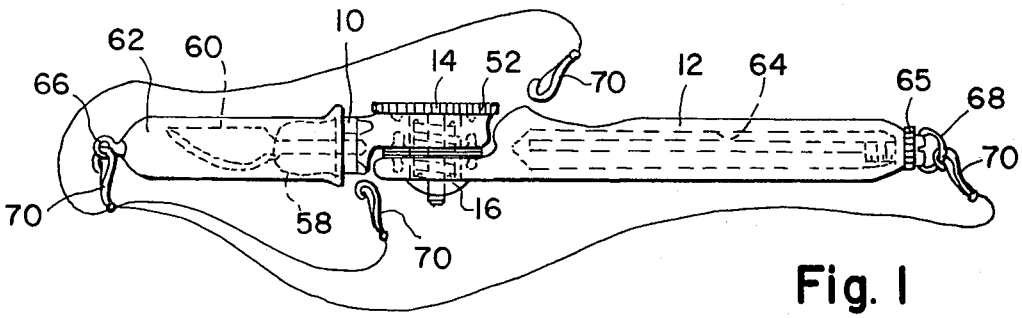
FIG. 1 is a side elevation of a preferred embodiment of the present invention.
Figure 2:
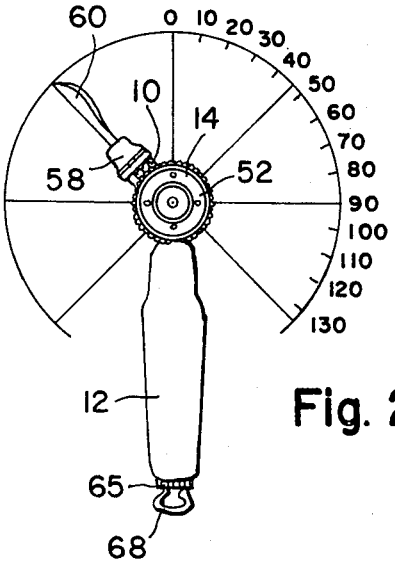
FIG. 2 is a plan view of the knife in the embodiment of FIG. 1.

Referring now to FIG. 1 and FIG. 2, a knife has a blade receiver 10 connected to a handle 12 by a pivot screw 14 which screws into a nut 16. As explained hereinafter, the blade receiver 10 may be pivoted with respect to the handle 12 about the screw 14 thereby providing a desired angle between the blade receiver 10 and the handle 12. Thereafter, by tightening the connection between the blade receiver 10 and the handle 12, the desired angle is securely maintained.

Figure 4:
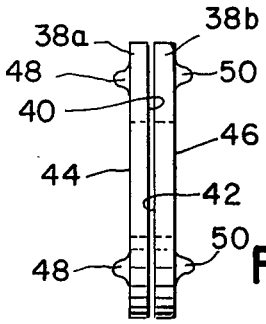
FIG. 4 is an edge view of discs used in the connection of the blade receiver and the handle.
Figure 3:
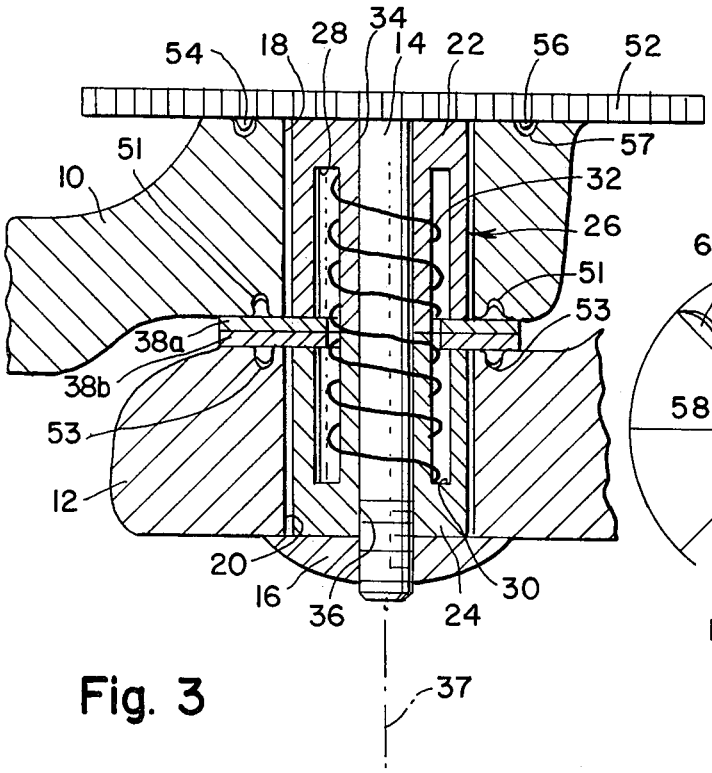
FIG. 3 is a side elevation, with parts broken away, of portions of a blade receiver and a handle which are connected together.

Referring now to FIG. 3 and FIG. 4, the blade receiver 10 and the handle 12 have respectively similar holes 18, 20 therethrough. Disposed within the holes 18, 20 are half sections 22, 24 of a spring retaining assembly 26. The sections 22, 24 have opposed annular slots 28, 30 where a coil spring 32 is maintained in compression. Additionally, the sections 22, 24 have opposed central holes 34, 36 through which the shank of the screw 14 passes. Because the spring 32 is maintained in compression, the spring 32 tends to push the sections 22, 24 apart along an axis 37 of the screw 14.

The blade receiver 10 and the handle 12 respectively include discs 38*a*, 38*b* having similar central holes therethrough. The discs 38 are mounted in axial alignment with the shank of the screw 14. It should be understood that the screw 14 and the spring 32 pass through the central holes of the discs 38.

The discs 38*a*, 38*b* (FIG. 4) are comprised of sandpaper having granular abrasive surfaces 40, 42, respectively. Additionally, the discs 38*a*, 38*b* have smooth sides 44, 46 which carry snap studs 48, 50.

The snap studs 48, 50 snap into snap holes 51, 53 respectively, whereby the discs 38*a*, is fixedly connected to the blade receiver 10, the disc 38*b* is fixedly connected to the handle 12 and the surfaces 40, 42 are in an abutting relationship. Because the surfaces 40, 42 are abutting abrasive surfaces, when the nut 16 is rotated clockwise with respect to the screw 14 (tightening the connection between the blade receiver 10 and the handle 12) the surfaces 40, 42 are pressed together, thereby preventing a pivoting of the handle 12 with respect to the blade receiver 10 about the axis 37. Correspondingly, when the nut 16 is rotated counterclockwise with respect to the screw 14, the surfaces 40, 42 are pushed apart by the spring 32 whereby the blade receiver 10 may be pivoted with respect to the handle 12. Therefore, the screw 14 and the nut 16 comprise a pivot operable to press the surfaces 40, 42 together. It should be understood that the surfaces 40, 42 function in a manner similar to plates of a friction clutch.

The screw 14 has a knurled head 52 which carries a pair of guide pins 54, 56. The pins 54, 56 are received in an annular slot 57 within the blade receiver 10. The pins 54, 56 and the slot 57 prevent undesired lateral motion of the screw with respect to the blade receiver 10. In an alternative embodiment the positions of the head of the pivot screw 14 and the nut 16 are reversed whereby the guide pins are received in an annular slot within a handle of a knife.

Referring again to FIG. 1 and FIG. 2, the blade receiver 10 includes an arrangement of a chuck and collet 58 within which a cylindrical shank of a knife blade 60 is removeably retained. A chuck and collet is a well known device for removeably retaining a cylindrical shank of a tool.

It should be appreciated that the blade 60 may be retained with the cutting edge of the blade 60 having any desired rotational position about the axis of the shank. A cover 62, which fits over the chuck and collet 58, may be used to cover the blade 60.

The handle 12 has a hollow interior 64 which is covered by a cap screw 65. The hollow interior 64 may be used for storing blades or other tools which are retainable within the chuck and collet 58. Additionally, the blade receiver 10 and the handle 12 have connected thereto rings 66, 68, respectively, where clips 70 may be attached for transporting the knife.

Although the invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. A knife comprising:

a handle having a first granular abrasive surface;

a blade receiver having a second granular abrasive surface, said blade receiver being adapted to receive a blade having a cylindrical shank; and a fastener which connects said handle and said blade receiver, said fastener being operable to press said abrasive surfaces together.

2. A knife according to claim 1 wherein said handle and said blade receiver have similar opposed holes therethrough, said fastener comprising:

a screw and a nut on the shank of said screw, said screw passing through said opposed holes, said handle and said blade receiver being mounted between the head of said screw and said nut.

3. A knife according to claim 2 additionally comprising:

a spring mounted within said opposed holes, said spring tending to push apart said blade receiver and said handle.

4. A knife according to claim 2 wherein the head of said screw carries a plurality of guide pins which are received in an annular slot within said blade receiver.

5. A knife according to claim 2 wherein the head of said screw carries a plurality of guide pins which are received in an annular slot within said handle.

6. A knife according to claim 1 wherein an abrasive surface comprises:

a sandpaper disc having an abrasive side and a smooth side; and a plurality of snap studs carried on the smooth side of said disc, said snap studs being adapted for connection within snap holes in said handle, and said blade receiver.

7. A knife according to claim 1 wherein said blade receiver comprises a chuck and collet adapted to receive said cylindrical shank.

* * * * *